US008398148B2

(12) United States Patent
Teramoto et al.

(10) Patent No.: US 8,398,148 B2
(45) **Date of Patent: *Mar. 19, 2013**

(54) METHOD AND SYSTEM FOR DISENGAGING A DRIVE ROD IN A DOOR AFTER AN IMPACT TO THE DOOR

(75) Inventors: Daisuke Teramoto, Toyota (JP); Kazuhiro Fukazawa, Northville, MI (US); David L. Minock, Fenton, MI (US); Christopher M. Higgins, Ypsilanti, MI (US); Nathaniel P. Jordan, Ann Arbor, MI (US); Jessica A. Riffe, Pinckney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/410,184

(22) Filed: Mar. 1, 2012

(65) Prior Publication Data

US 2012/0192494 A1 Aug. 2, 2012

Related U.S. Application Data

(63) Continuation of application No. 12/557,961, filed on Sep. 11, 2009, now Pat. No. 8,128,151.

(51) Int. Cl.
*E05C 9/10* (2006.01)

(52) U.S. Cl. ..... 296/146.1; 292/259 A; 296/187.12

(58) Field of Classification Search ..... 292/53, 292/86, 259 A, DIG. 23, DIG. 41; 296/146.1, 296/187.12

See application file for complete search history.

(56) References Cited

U.S. PATENT DOCUMENTS

| | | | |
|---|---|---|---|
| 3,596,956 | A | 8/1971 | Yoshie |
| 4,466,645 | A | 8/1984 | Kobayashi |
| 4,497,514 | A | 2/1985 | Moriya et al. |
| 4,580,821 | A | 4/1986 | Genord, Jr. et al. |
| 4,775,176 | A | 10/1988 | Ikeda |
| 5,058,938 | A | 10/1991 | Doring et al. |
| 5,154,457 | A | 10/1992 | Watanabe |
| 5,253,906 | A | 10/1993 | Rogers, Jr. et al. |
| 5,265,920 | A | 11/1993 | Kaup et al. |
| 5,431,462 | A | 7/1995 | Lignell |
| 5,492,379 | A | 2/1996 | Staser et al. |
| 5,584,516 | A | 12/1996 | Cetnar |
| 5,782,114 | A | 7/1998 | Zeus et al. |

(Continued)

FOREIGN PATENT DOCUMENTS

| | | |
|---|---|---|
| EP | 0013255 | 7/1980 |
| EP | 439378 | 7/1991 |

(Continued)

*Primary Examiner* — Glenn Dayoan
*Assistant Examiner* — Paul Chenevert
(74) *Attorney, Agent, or Firm* — Snell & Wilmer LLP

(57) ABSTRACT

A method and system for disengaging a drive rod in a door after an impact to the door. An automobile having a door with a door handle, a drive rod, a latching system, a striker, and a drive rod striking member. The drive rod striking member can be positioned adjacent the drive rod. Upon impact to the door, the drive rod is disengaged from the door handle and/or the latching system through inertia, through the drive rod striking member impacting the drive rod, or through any other disengagement mechanisms. The drive rod striking member prevents the drive rod from re-engaging with the latching system. The disengagement of the drive rod prevents the drive rod from controlling the latching system to disengage from the striker, either through deformation of the door, or through actuations by the door handle.

20 Claims, 6 Drawing Sheets

U.S. PATENT DOCUMENTS

| | | | | |
|---|---|---|---|---|
| 5,855,400 | A | 1/1999 | Ohhashi et al. | |
| 6,065,797 | A | 5/2000 | Shirasaka | |
| 6,155,618 | A | 12/2000 | Ichinose | |
| 6,168,216 | B1 | 1/2001 | Nakajima et al. | |
| 6,419,286 | B1 | 7/2002 | Szablewski | |
| 6,428,058 | B1 | 8/2002 | Graute | |
| 6,464,270 | B1 | 10/2002 | Sloan et al. | |
| 6,519,986 | B2 | 2/2003 | Wicker | |
| 6,685,239 | B2 | 2/2004 | Yamauchi et al. | |
| 6,779,820 | B2 | 8/2004 | Ogino | |
| 6,810,699 | B2 | 11/2004 | Nagy | |
| 6,880,866 | B2 | 4/2005 | Tomaszewski et al. | |
| 6,880,867 | B2 | 4/2005 | Schoen et al. | |
| 6,929,293 | B2 | 8/2005 | Tonges | |
| 7,128,349 | B2 | 10/2006 | Bendel et al. | |
| 7,159,907 | B2 | 1/2007 | Song | |
| 7,224,259 | B2 | 5/2007 | Belmond et al. | |
| 7,303,224 | B2 | 12/2007 | Kim | |
| 7,380,845 | B2 | 6/2008 | Suzumura et al. | |
| 7,789,455 | B2 | 9/2010 | Hall et al. | |
| 8,079,631 | B2 | 12/2011 | Higgins et al. | |
| 8,235,451 | B2 * | 8/2012 | Jordan et al. | 296/146.1 |
| 2003/0160462 | A1 | 8/2003 | Tonges | |
| 2004/0201229 | A1 | 10/2004 | Shabana et al. | |
| 2005/0012345 | A1 | 1/2005 | Saitoh | |
| 2005/0146147 | A1 | 7/2005 | Niskanen et al. | |
| 2006/0103145 | A1 | 5/2006 | Ottolini et al. | |
| 2006/0175845 | A1 | 8/2006 | Arabia, Jr. et al. | |
| 2006/0261602 | A1 | 11/2006 | Jankowski et al. | |
| 2007/0029835 | A1 | 2/2007 | Herline et al. | |
| 2007/0069525 | A1 | 3/2007 | Ghannam | |
| 2007/0158954 | A1 | 7/2007 | Warmke et al. | |
| 2007/0182165 | A1 | 8/2007 | Yoshikuwa et al. | |
| 2008/0185850 | A1 | 8/2008 | Takaya et al. | |
| 2008/0277947 | A1 | 11/2008 | Costigan | |
| 2009/0064591 | A1 | 3/2009 | Keller et al. | |
| 2009/0224569 | A1 | 9/2009 | Lagrut | |
| 2010/0019512 | A1 | 1/2010 | Gschweng et al. | |
| 2010/0109350 | A1 | 5/2010 | Gschweng et al. | |
| 2011/0062747 | A1 | 3/2011 | Teramoto et al. | |
| 2011/0115251 | A1 | 5/2011 | Jordan et al. | |
| 2011/0115252 | A1 | 5/2011 | Higgins et al. | |

FOREIGN PATENT DOCUMENTS

| | | |
|---|---|---|
| GB | 2275727 | 9/1994 |
| GB | 2361675 | 10/2001 |
| JP | 2001/262901 | 9/2001 |
| JP | 2009024328 | 2/2009 |
| KR | 2001087451 | 9/2001 |
| KR | 765836 | 10/2007 |
| WO | WO 82/00848 | 3/1982 |

* cited by examiner

METHOD AND SYSTEM FOR DISENGAGING A DRIVE ROD IN A DOOR AFTER AN IMPACT TO THE DOOR

CLAIM OF PRIORITY UNDER 35 U.S.C. §120

The present application is a continuation application of U.S. patent application Ser. No. 12/557,961, entitled "Method and System for Disengaging a Drive Rod in a Door after an impact to the Door," filed on Sep. 11, 2009 now U.S. Pat. No. 8,128,151. The entire disclosure of the patent application is assigned to the assignee hereof.

BACKGROUND

1. Field of the Invention

The present invention relates generally to a safety mechanism for an automobile door and more particularly to a method and system for disengaging a drive rod in a door after an impact to the door.

2. Description of the Related Art

A conventional automobile includes a conventional door that opens in an outward direction. The conventional door is opened using a handle, a drive rod, a latching system, and a striker. Actuation of the handle moves the drive rod, which in turn controls the latching system to engage or disengage from the striker. During an accident where there is an impact to the door, the door can be deformed and compressed. The deformation and compression will move the latching system closer to the handle such that the drive rod permanently controls the latching system to disengage from the striker, causing the door to be in a permanent or semi-permanent open position. Having the door be left permanently or semi-permanently open is undesirable.

Thus, there is a need for a method and system for disengaging a drive rod in a door after an impact to the door.

SUMMARY

The present invention is a method and system for disengaging a drive rod in a door after an impact to the door. The present invention includes an automobile having a door with a door handle, a drive rod, a latching system, a striker, and a drive rod striking member. The drive rod striking member can be positioned adjacent to the drive rod. Upon impact to the door, the drive rod is disengaged from the door handle and/or the latching system either through inertia, the drive rod striking member impacting the drive rod, or any other means. The drive rod striking member prevents the drive rod from re-engaging with the latching system. The disengagement of the drive rod prevents the drive rod from controlling the latching system to disengage from the striker, either through deformation of the door, or through actuations by the door handle. This maintains the door in the closed position instead of the open position.

In one embodiment, a latch system may include a door, a rod located in the door and a latch located in the door and engaged with the rod. An impacting element is located in the door and separated from the rod, the impacting element configured to impact the rod for disengaging the rod from the latch and preventing the rod from re-engaging with the latch by separating the rod a distance from the latch.

In another embodiment, a latch system may include a door defining a cavity therein, a handle coupled with the door and a rod disposed in the cavity of the door and coupled with the handle, the rod configured to actuate in the cavity based upon manipulation of the handle. A latch is disposed in the cavity of the door and coupled with the rod, the latch configured to allow an opening of the door based upon actuation of the rod. A striking plate is disposed in the cavity of the door and adjacent to the rod, the striking plate configured to initially engage the rod for decoupling the rod from the latch and subsequently preventing the rod from moving to within a distance of the latch.

In yet another embodiment a door latch system may include a door including an outer panel and an inner panel, the outer panel and the inner panel opposing each other, a door handle coupled with the outer panel of the door, a latch release unit located in the door and a drive rod engaged with the door handle and the latch release unit. A drive rod striking member is coupled with the inner panel of the door and separated from the drive rod, wherein upon impact to the door causing deformation of the door, the drive rod striking member is configured to contact the drive rod and prevent the drive rod from being engaged to the door handle or the latch release unit.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems and methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

Figure 1:
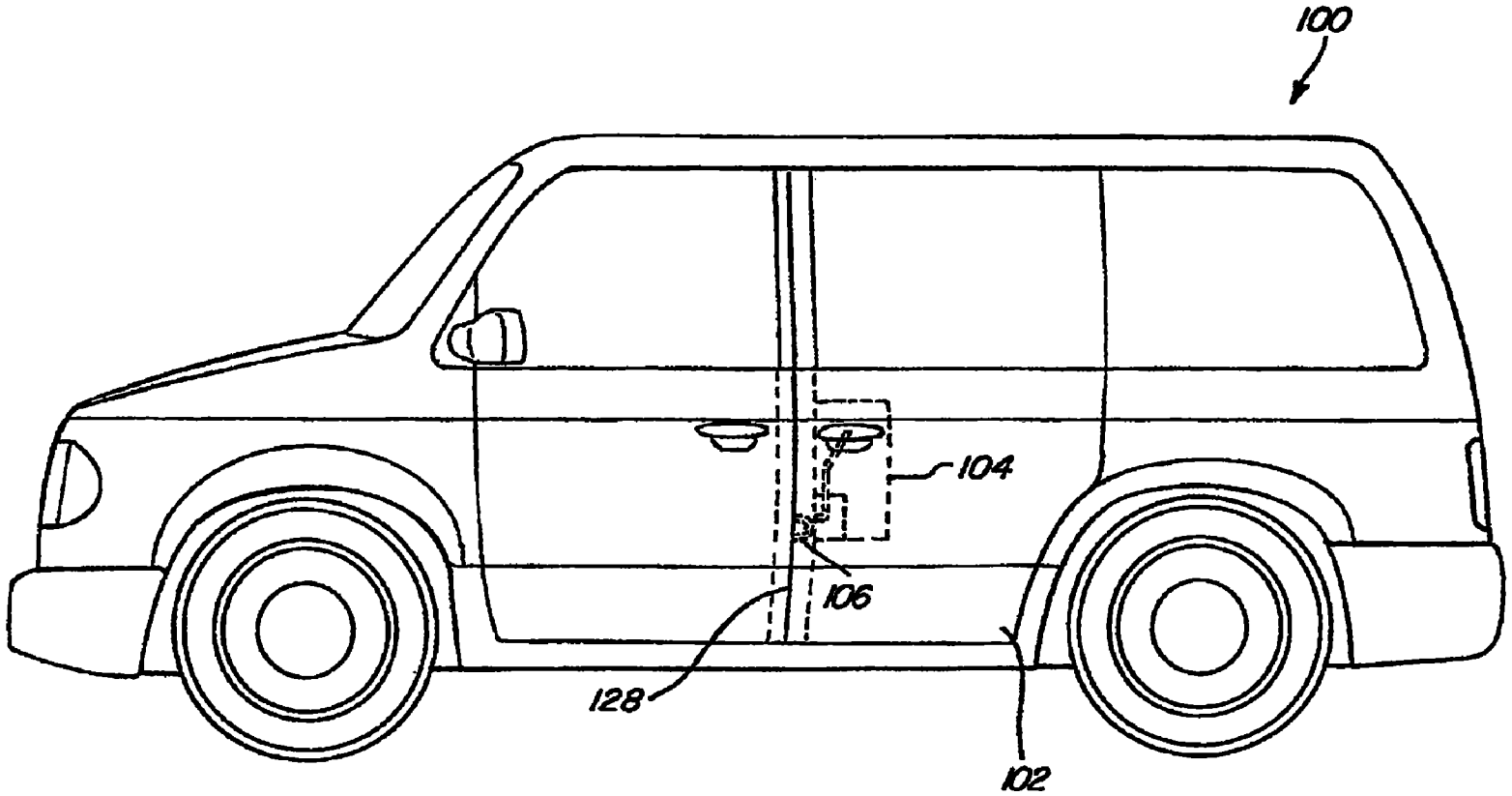
FIG. 1 depicts an automobile including a latching system according to an embodiment of the present invention.

As seen in FIG. 1, a transportation device such as an automobile 100 includes a door 102, a door lock assembly 104, a striker 106, and a frame 128. The automobile 100 can be, for example, a car, a hybrid car, a car with an internal combustion engine, or any other type of vehicle which can be used to transport objects. The striker 106 is connected to the frame 128 of the automobile 100. The door 102 includes the door lock assembly 104, which is selectively engaged to the striker 106. The door 102 can be, for example, a sliding door, or a hinged door. When the door lock assembly 104 is engaged with the striker 106, the door 102 is secured to the frame 128. When the door lock assembly 104 is not engaged with the striker 106, the door 102 can be opened.

Figure 2:
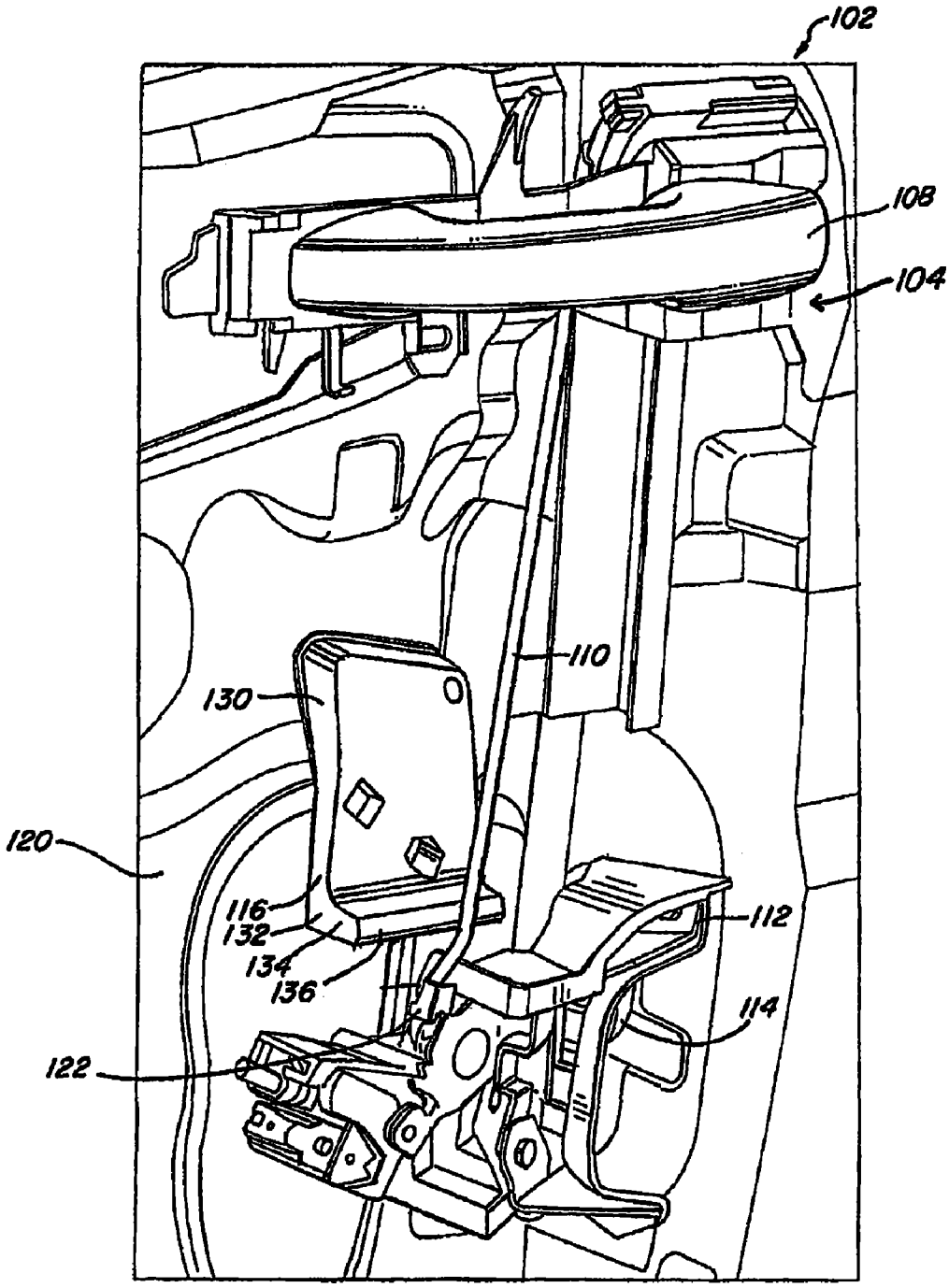
FIG. 2 is a perspective view of a door without an outer panel according to an embodiment of the present invention.
Figure 3:
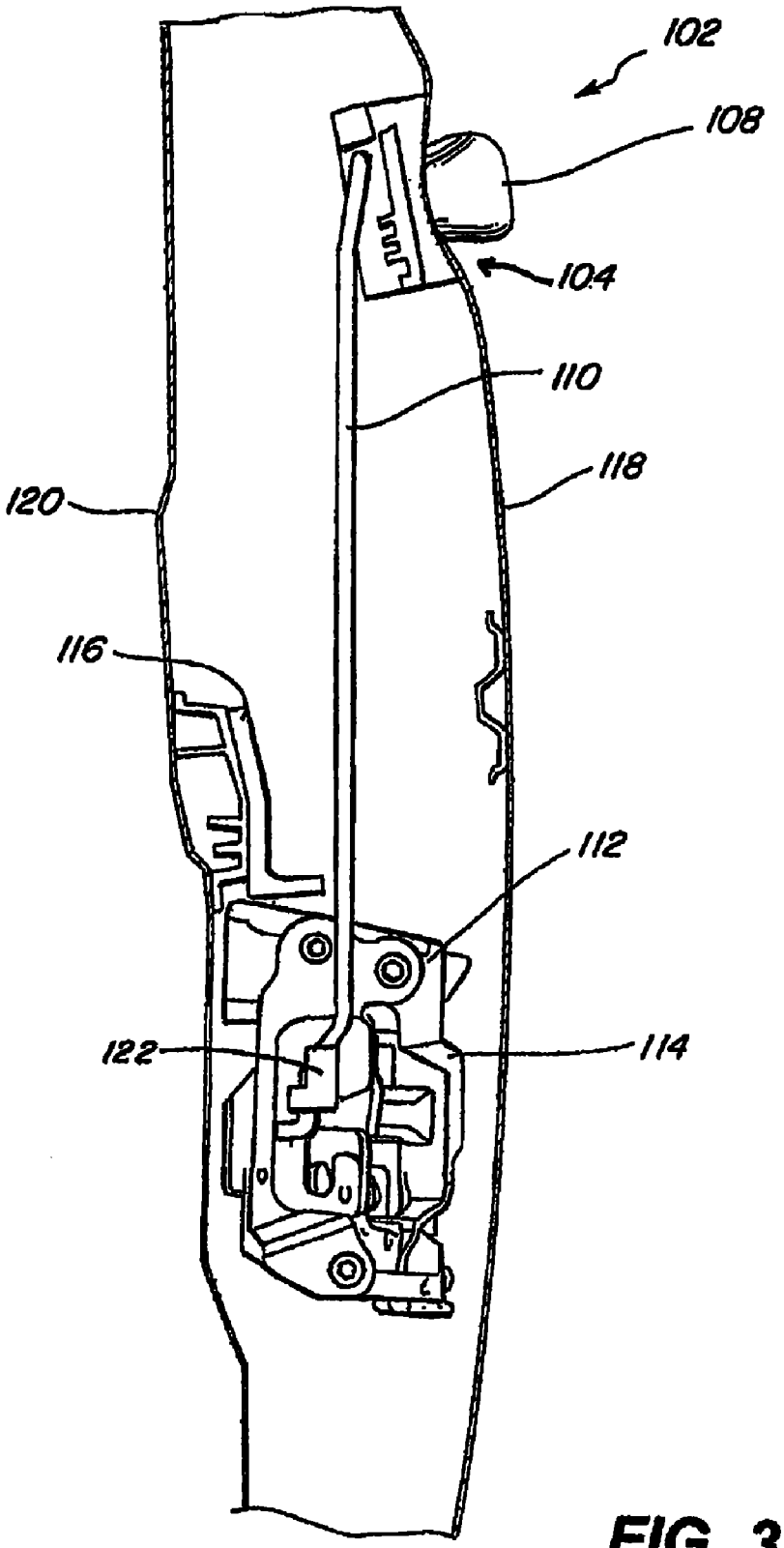
FIG. 3 is a side view of a door according to an embodiment of the present invention.

The door lock assembly 104 can be seen, for example in FIGS. 2 and 3. FIG. 2 is a perspective view of the door 102 without an outer panel, while FIG. 3 is a side view of the door 102. The door 102 in FIG. 3 includes a first panel 118 and a second panel 120. In FIG. 2, only the second panel 120 is shown. The first panel 118 can be, for example, an outer panel, while the second panel 120 can be, for example, an inner panel.

In FIGS. 2 and 3, the door lock assembly 104 can include a door handle 108, a drive rod 110, a drive rod striking member 116 and/or a latching system 112. The door handle 108 is connected to the first panel 118, and is engaged with the drive rod 110. The drive rod 110 is engaged to the latching system 112 while the latching system 112 is connected to the striker 106 (FIG. 1). The latching system 112 can be located in the door 102 and can be between, for example, the first panel 118 and/or the second panel 120. In one embodiment, the latching system 112 is connected to the second panel 120. The latching system 112 can include, for example, a latch release unit 122 and a latch unit 114. The latch release unit 122 and the latch unit 114 can be separate units or the same unit. In addition, the latch release unit 122 and the latch unit 114 can be integrated together. Furthermore, in one embodiment, the drive rod 110, the latch release unit 122, and/or the latch unit 114 can form a bell crank.

The drive rod striking member 116 is located in the door 102 and is positioned adjacent to the drive rod 110. In FIG. 2, the drive rod striking member 116 can include, for example, an attachment portion 130, and a striking protrusion 132. The striking protrusion 132 can include, for example, a base 134, and a tip 136. However, the drive rod striking member 116 can be formed from any shape or size such that it is capable of disengaging the drive rod 110 from the door handle 108 and/or the latching system 112. The drive rod striking member 116 can be formed, for example, from steel, plastic, aluminum, an alloy, or any other suitable material with sufficient rigidity to disengage the drive rod 110 from the door handle 108 and/or the latching system 112.

In one embodiment, the drive rod striking member 116 can be connected to the second panel 120, for example, through the attachment portion 130. In another embodiment, the drive rod striking member 116 can be located on or adjacent to the latching system 112, including being located on the first panel 118. For example, the drive rod striking member 116 can be integrated into the latching system 112. In yet another embodiment, the drive rod striking member 116 can be located on or adjacent to the door handle 108. For example, the drive rod striking member 116 can be integrated into the door handle 108.

Generally, the drive rod striking member 116 can be located anywhere in or on the door 102 such that it can impact or contact the drive rod 110 when the door 102 is impacted by an object. Although not shown, a cushioning material can be placed between the drive rod striking member 116 and the drive rod 110. This can ensure that the drive rod striking member 116 is sufficiently adjacent to the drive rod 110, but will not accidentally contact the drive rod 110 prior to an impact to the automobile 100 or disengage the drive rod 110 from the door handle 108 and/or the latching system 112 prior to an impact to the door 102.

The drive rod striking member 116 can impact the drive rod 110 at any point along the drive rod 110 which is sufficient to disengage the drive rod 110 from the handle 108 and/or the latching system 112. For example, the drive rod striking member 116 can impact the drive rod 110 at a point close to the handle 108, a point close to the latching system 112, and/or a point between the handle 108 and the latching system 112.

In operation, the door handle 108 can be actuated to move the drive rod 110. The movement of the drive rod 110 moves the latch release unit 122, and the latch release unit 122 moves the latch unit 114. The latch unit 114 can be moved to engage with the striker 106 or disengage with the striker 106. The drive rod striking member 116 ensures that the drive rod 110 is disengaged from the latching system 112 after impact to the automobile 100 and/or the door 102.

In one embodiment, upon impact to the automobile 100 and/or the door 102, the drive rod striking member 116 contacts the drive rod 110 and disengages the drive rod 110 from the door handle 108 and/or the latching system 112. For example, the tip 136 can contact the drive rod 110. By using the tip 136, energy from the drive rod striking member 116 can be concentrated in a small location, producing concentrated force on the drive rod 110. In another embodiment, upon impact to the automobile 100 and/or the door 102, the drive rod 110 is disengaged from the door handle 108 and/or the latching system 112. The drive rod striking member 116 then contacts the drive rod 110 and prevents the drive rod 110 from re-engaging with the latching system 112.

Since the drive rod 110 is disengaged from the latching system 112 and/or the door handle 108, the drive rod 110 will not cause the latching system 112 to disengage from the striker 106. This is advantageous when the door 102 deforms and/or compresses such that the door handle 108 is closer to the latching system 112. The reduced distance may cause the drive rod 110 to force the latching system 112 to disengage from the striker 106 in a conventional door. This can simulate, for example, an actuation of the door handle 108, and lead to the opening of the door. However, since the drive rod 110 is disengaged from the door handle 108 and/or the latching system 112 in the present invention, the drive rod 110 will not cause the latching system 112 to disengage from the striker 106. This can prevent the door 102 from undesirably opening during or after an accident. This can improve the safety to the occupants within the automobile 100 and/or prevent further damage to the automobile 100.

Similarly, if the drive rod 110 is disconnected from the latching system 112, any actuations of the door handle 108 will only move the drive rod 110 without causing the latching system 112 to disengage from the striker 106. Since the movement of the drive rod 110 does not affect the latching system 112, it does not cause the latching system 112 to disengage from the striker 106. This can prevent the door 102 from undesirably opening during or after an accident, for example, through unintended actuations of the door handle 108.

FIGS. 4-8 depict simulations of the door 102 prior to, during, and after an impact with an object 124. The object 124 can be mounted, for example, to an object 126. The object 124 can protrude from the object 126. The objects 124 and/or 126 can simulate an impact with real life objects such as another automobile, a wall, a tree, or any other object which can cause damage to the door 102.

Figure 4:
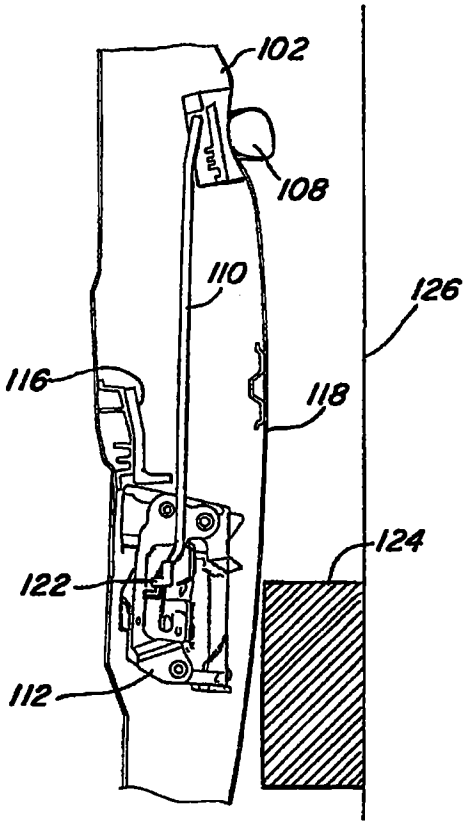
FIG. 4 is a side view of a door prior to an impact with an object according to an embodiment of the present invention.

FIG. 4 depicts the door 102 prior to the impact with the object 124. As can be seen in FIG. 4, the drive rod 110 is engaged with the door handle 108 and the latching system 112. The drive rod striking member 116, for example, has not impacted the drive rod 110. Thus, actuating the door handle 108 causes the latching system 112 to be disengaged with the striker 106 (FIG. 1).

Figure 5:
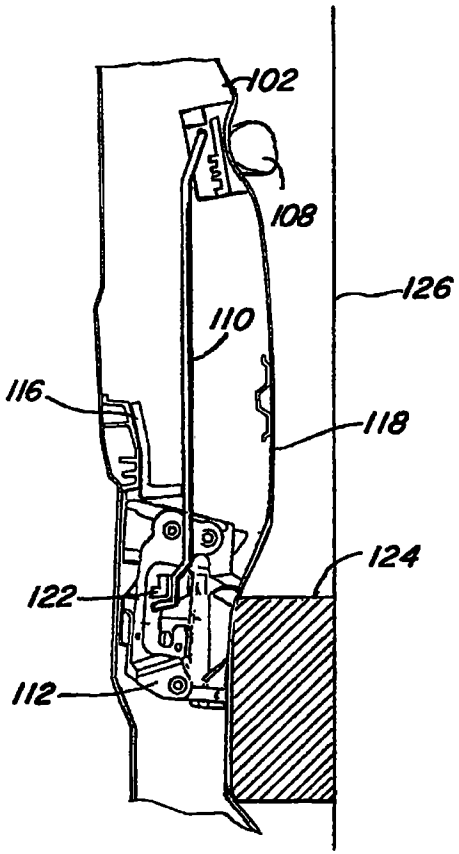
FIG. 5 is a side view of a door during an impact with an object according to an embodiment of the present invention.

FIG. 5 depicts the door 102 immediately after impact with the object 124. The first panel 118 begins to deform due to the impact with the object 124. The deformation of the first panel 118 causes the latching system 112 to move closer to the second panel 120. The deformation of the first panel 118 can also cause the latching system 112 to move closer to the door handle 108. The drive rod 110 disengages from the latching system 112. For example, the drive rod 110 can separate from the latch release unit 122 in the latching system 112. In one embodiment, the drive rod 110 can separate from the latching system 112, for example, from inertia and/or the movement of the latching system 112 without the drive rod striking member 116 impacting the drive rod 110. In another embodiment, the drive rod striking member 116 impacts the drive rod 110 to disengage the drive rod 110 from the latching system 112.

Figure 6:
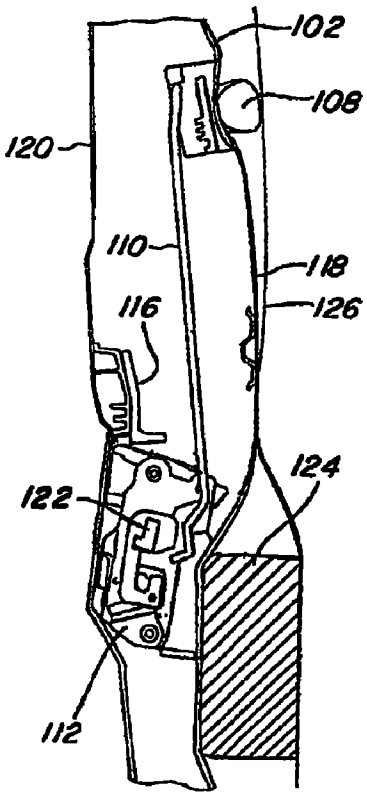
FIG. 6 is a side view of a door during an impact with an object according to an embodiment of the present invention.

FIG. 6 depicts the door 102 with greater deformation from the impact with the object 124. As can be seen in FIG. 6, the drive rod 110 moves or swings away from the latching system 112. The drive rod 110 can move or swing due to the contact from the drive rod striking member 116, the inertia, and/or the movement of the latching system 112 due to the deformation of the first door panel 118 and/or the second door panel 120.

Figure 7:
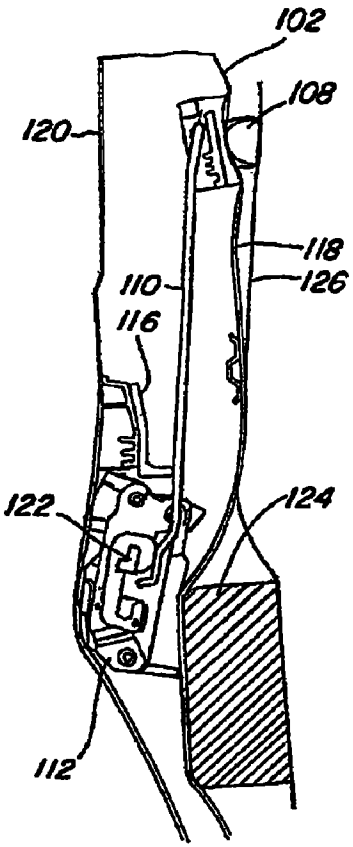
FIG. 7 is a side view of a door during an impact with an object according to an embodiment of the present invention.

FIG. 7 depicts the door 102 at a time after FIG. 6. As seen in FIG. 7, the drive rod 110 moves or swings back towards the latching system 112. The drive rod striking member 116, however, prevents the drive rod 110 from re-engaging with the latching system 112.

Figure 8:
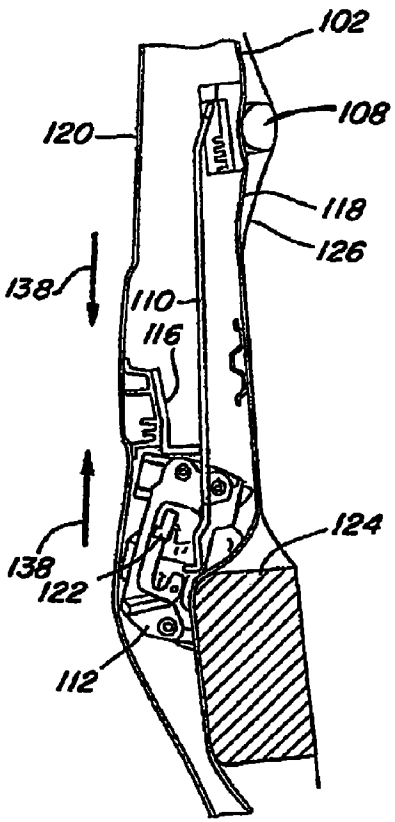
FIG. 8 is a side view of a door after an impact with an object according to an embodiment of the present invention.

FIG. 8 depicts the door 102 after the door 102 has completed its deformation from its impact with the object 124. As can be seen, the door 102 has suffered compression along the arrows 138. The door handle 108 is now closer to the latching system 112. However, the drive rod striking member 116 prevents the drive rod 110 from re-engaging with the latching system 112. In a conventional door 102, the compression along the arrows 138 could cause the drive rod 110 to force the latching system 112 to disengage from the striker 106. However, in the present invention, the drive rod 110 is prevented from re-engaging with the latching system 112, and the drive rod 110 does not actuate the latch release unit 122 and/or the latch unit 114 in the latching system 112 due to the compression along the arrows 138.

Figure 9:
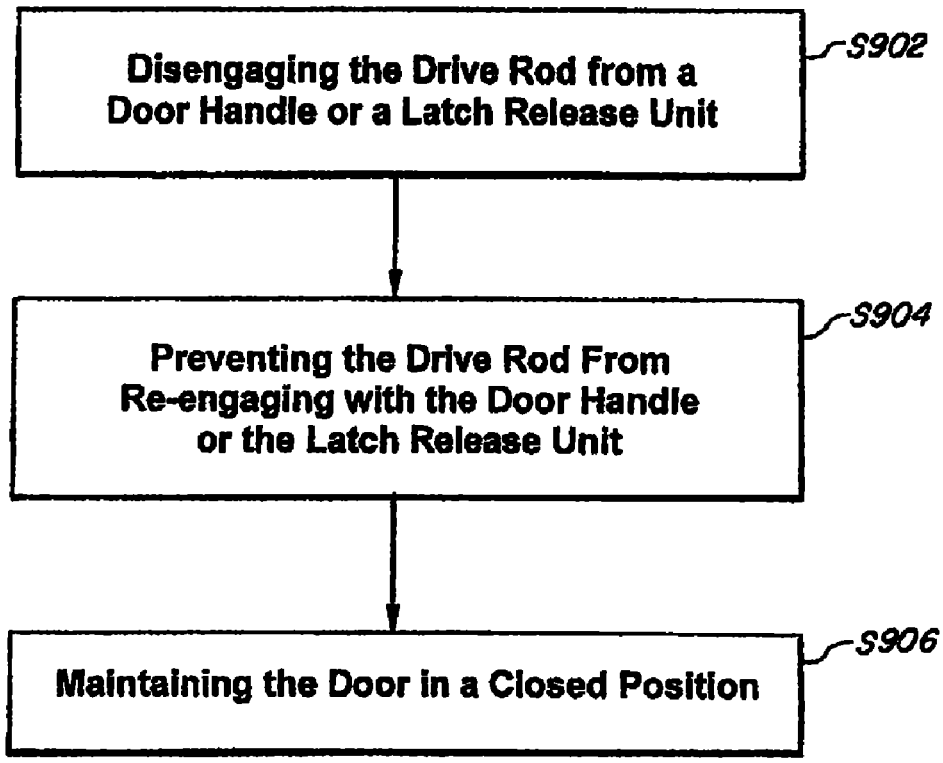
FIG. 9 is a flow chart for a process according to an embodiment of the present invention.

In one embodiment, the present invention is a process as disclosed in FIG. 9. In Step S902, the drive rod 110 is disengaged from a door handle or a latch release unit. For example, the drive rod 110 can be disengaged from the door handle 108 and/or the latch release unit 122 and/or the latch unit 114 from the latching system 112. The drive rod 110 can be disengaged from the door handle 108 and/or the latch release unit 122 from inertia and/or an impact from the drive rod striking member 116.

In Step S904, the drive rod 110 is prevented from re-engaging with the door handle or the latch release unit 122. For example, the drive rod striking member 116 prevents the drive rod 110 from re-engaging with the door handle 108 and/or the latching system 112. In Step S906, the door is maintained in a closed position. For example, the drive rod 110 is disengaged from the door handle 108 and/or the latching system 112 and thus does not release the latch unit 114 from the striker 106. This maintains the door 102 in the closed position.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A latch system comprising:
a door positioned along a vertical plane and separating an outside space from an inside space;
a latch located in the door;
a rod engaged with the latch; and
an impacting element located in the door and separated from the rod,
wherein upon an applied force to the door from the outside space causing deformation of the door, the impacting element is configured to impact the rod in a direction substantially perpendicular to the vertical plane and towards the outside space after the rod has disengaged from the latch, and
wherein the impacting element prevents the rod from re-engaging with the latch.

2. The latch system of claim 1 wherein the impacting element is configured to apply an initial impact to the rod to separate the impacting element from the rod after the initial impact to the rod and apply a subsequent impact to the rod for separating the rod a distance from the latch.

3. The latch system of claim 1 wherein the door includes an inner panel and an outer panel defining a space therebetween, the impacting element coupled with the inner panel of the door.

4. The latch system of claim 1 wherein the impacting element includes a first portion for coupling with the door and a second portion for impacting the rod.

5. The latch system of claim 4 wherein the first portion is disposed substantially along a first axis and the second portion is disposed substantially along a second axis different from the first axis.

6. The latch system of claim 5 wherein the first portion and the second portion form a substantially L-shaped configuration.

7. The latch system of claim 5 wherein the second portion includes a base end connected to the first portion and a tip end narrower than the base end, the impacting element configured to impact the rod at the tip end for concentrating a force of the impact.

8. The latch system of claim 1 wherein the latch includes a latch unit and a latch release unit, the latch release unit engaged with the rod and configured to disengage from the rod when the rod is impacted by the impacting element.

9. A latch system comprising:
a door defining a cavity therein, the door separating an outside space from an inside space;
a handle located on the door;
a latch disposed in the cavity of the door;
a rod disposed in the cavity of the door and coupled with the handle, the rod configured to actuate in the cavity based upon manipulation of the handle; and
a striking plate disposed in the cavity of the door,
wherein upon an applied force from the outside space to the door causing deformation of the door, the striking plate is configured to impact the rod towards the outside space after the rod has disengaged from the handle or the latch, and
wherein the striking plate prevents the rod from moving to within a distance of the latch.

10. The latch system of claim 9 wherein the striking plate is configured to subsequently re-impact the rod for the preventing the rod from moving to within the distance of the latch.

11. The latch system of claim 10 wherein the striking plate includes an attaching portion coupled to the door and a protrusion extending towards the rod for impacting the rod.

12. The latch system of claim 11 wherein the attaching portion is disposed along a first plane and the protrusion is disposed along a second plane different from the first plane.

13. The latch system of claim 9 wherein the door includes an outer panel and an inner panel opposing the outer panel, the handle coupled with the outer panel of the door and the striking plate coupled with the inner panel of the door.

14. The latch system of claim 13 wherein the striking plate applies an initial impact to the rod to move the rod in a direction away from the inner panel of the door.

15. A door latch system comprising:

a door separating an outside space from an inside space and including an outer panel and an inner panel, the outer panel and the inner panel opposing each other;

a door handle coupled with the outer panel of the door;

a latch release unit located in the door;

a drive rod engaged with the door handle and the latch release unit; and a drive rod striking member coupled with the inner panel of the door and separated from the outer panel and the drive rod, wherein upon an applied force from the outside space to the door causing deformation of the door, the drive rod striking member is configured to impact the drive rod towards the outside space after the drive rod has disengaged from the door handle or the latch release unit, and wherein the drive rod striking member prevents the drive rod from re-engaging with the door handle or the latch release unit.

16. The door latch system of claim 15 wherein the drive rod striking member applies an initial impact to the drive rod to move the drive rod closer to the outer panel of the door and to disengage the drive rod from the door handle or the latch release unit.

17. The door latch system of claim 15 further comprising:

a latch unit engaged to the latch release unit and configured to be actuated by the drive rod; and a striker selectively engaged with the latch unit based on the actuations of the drive rod, wherein the door is in a closed state when the latch unit is engaged with the striker and the door is in an open state when the latch unit is disengaged from the striker.

18. The door latch system of claim 15 wherein the drive rod striking member includes an attachment portion for attaching the drive rod striking member to the inner panel of the door and a striking protrusion extending from the attachment portion for impacting the drive rod.

19. The door latch system of claim 18 wherein the striking protrusion includes a base connected to the attachment portion and a tip, the striking protrusion configured to impact the drive rod at the tip.

20. The door latch system of claim 18 wherein the attachment portion and the striking protrusion are substantially perpendicular to each other.

* * * * *